United States Patent [19]

French

[11] 4,022,437

[45] May 10, 1977

[54] BATTER-BOARD SUPPORT

[76] Inventor: Raymond L. French, 108 Bow St., Lexington, Mass. 02173

[22] Filed: Jan. 12, 1976

[21] Appl. No.: 648,181

[52] U.S. Cl. ..... 256/26; 249/3; 249/208

[51] Int. Cl.[2] ..... E04H 17/16

[58] Field of Search ..... 272/3; 256/26, 24; 52/629; 249/3–7, 208, 205

[56] References Cited

UNITED STATES PATENTS

| | | | |
|---|---|---|---|
| 1,109,433 | 9/1914 | Leydecker | 249/5 |
| 1,345,179 | 6/1920 | Heltzel | 249/5 |
| 1,366,744 | 1/1921 | Page | 52/155 |
| 1,382,082 | 6/1921 | Heltzel | 249/6 |

*Primary Examiner*—Werner H. Schroeder
*Assistant Examiner*—Doris L. Troutman

[57] ABSTRACT

A support for a batter-board encircling a skating surface. The support includes a vertical fluke which is driven into the ground and a horizontally extending arm which is secured to the fluke. The batter-board rests against the horizontal arm and the vertical fluke and is held in place by a vertical tab extending from the horizontal arm or by an L-shaped bracket extending from the vertical fluke. The length of the fluke above the horizontal member is adjustable to accommodate a variety of batter-board widths.

9 Claims, 5 Drawing Figures

BATTER-BOARD SUPPORT

The invention relates to an anchoring device for securing a batter-board around the perimeter of a skating surface.

Ice skating rinks for home recreational use are frequently constructed for assembly for use in the winter and then disassembly for storage. It is desirable that such rinks be sturdy and rugged enough to prevent injuries to the skaters, yet simple enough to assemble and disassemble quickly using only basic hand tools.

Typically, ice skating rinks include a waterproof liner and a batter-board around the perimeter of the liner. To construct the rink, the batter board is assembled on a flat, smooth surface. The liner is laid on the surface and draped over the batter-board. The surface is flooded with water which is confined by the liner and batter-board freezes to provide a skating surface.

The board further serves to prevent skaters from accidentally sliding off the ice. In addition, for games of hockey, the batter-board helps to keep the puck in play. The board must be securely held in place or the frequent pounding from pucks and skates will dislodge it.

A common batter-board assembly for home recreational use is made of corrugated sheet metal sections secured together. Such batter-boards are expensive and difficult to assemble and bulky to store.

SUMMARY OF THE INVENTION

It is an object of this invention to provide a strong yet inexpensive batter-board support.

It is another object of this invention to provide a batter-board support which adapts to a range of board widths.

It is a further object of this invention to provide a batter-board support which may be simply and quickly installed and disassembled.

Yet another object of the invention is to provide a batter-board and support assembly which is conveniently stored when the rink is disassembled.

In accordance with the invention, I provide a batter-board support having a vertical fluke and a horizontal are which secures to the fluke. In one embodiment of the invention, a vertical tab extends from the horizontal arm to form a channel between the tab and the fluke. In another embodiment, the fluke includes an extension which is extendable to adjust the length of the fluke above the horizontal arm and thereby secure various width batter-board. A slot in the extension aligns with a slot in the fluke and an L-shaped bracket at the end of the extension fits over the top and edge of the board to secure it in place. A screw passes through the aligned slots to secure the extension to the fluke.

The support described above is readily adjustable to accommodate a wide range of batter-board widths and simplifies the replacement of boards. Further, the support is easily installed and disassembled using only simple hand tools. It can be seen that the support is well adapted to receive commonly available lumber which is inexpensive and may be compactly stored when the rink is disassembled.

BRIEF DESCRIPTION OF THE DRAWINGS

The foregoing and other and further objects and features of the invention will be more readily understood from the following detailed description of the invention when taken in conjunction with the accompanying drawings in which.

DETAILED DESCRIPTION OF THE EMBODIMENT

Figure 1:
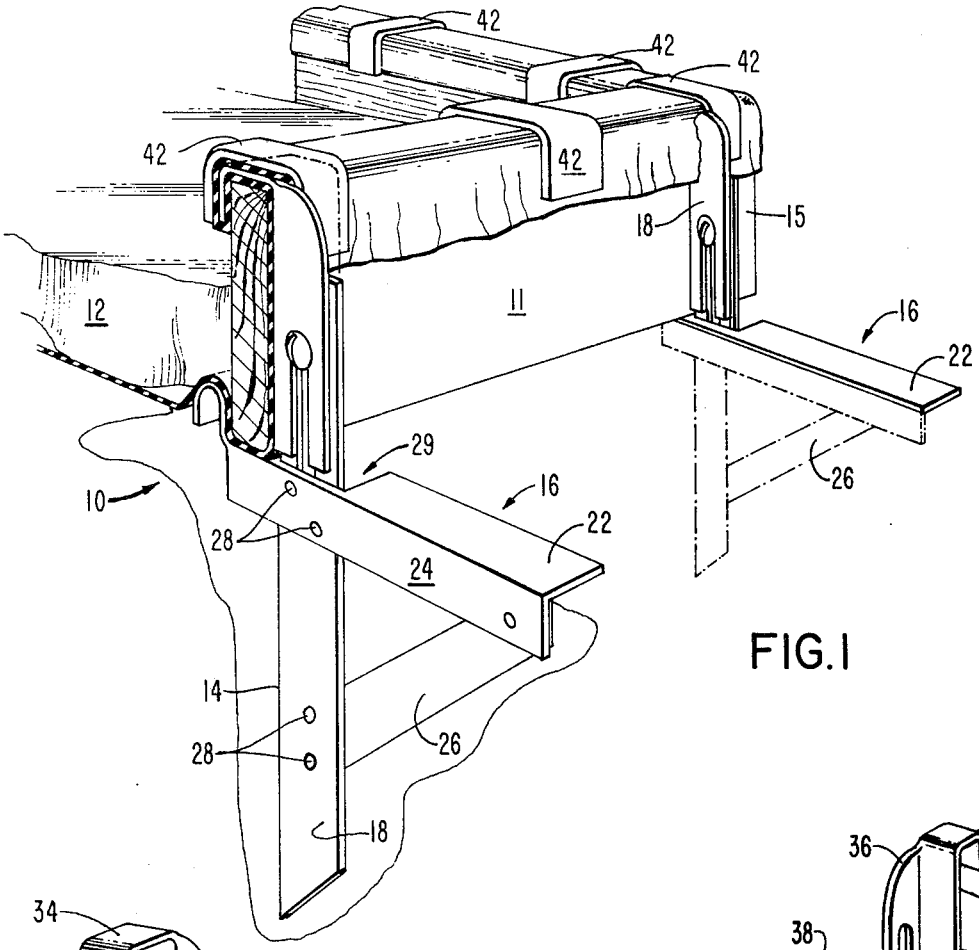
FIG. 1 is a cut-away view of one embodiment of the invention shown securing a batter-board around the perimeter of a skating rink.

In FIG. 1, a batter-board support 10 in accordance with the invention retains a batter-board 11 which surround a skating surface and a water impervious liner 12.

Figure 2A:
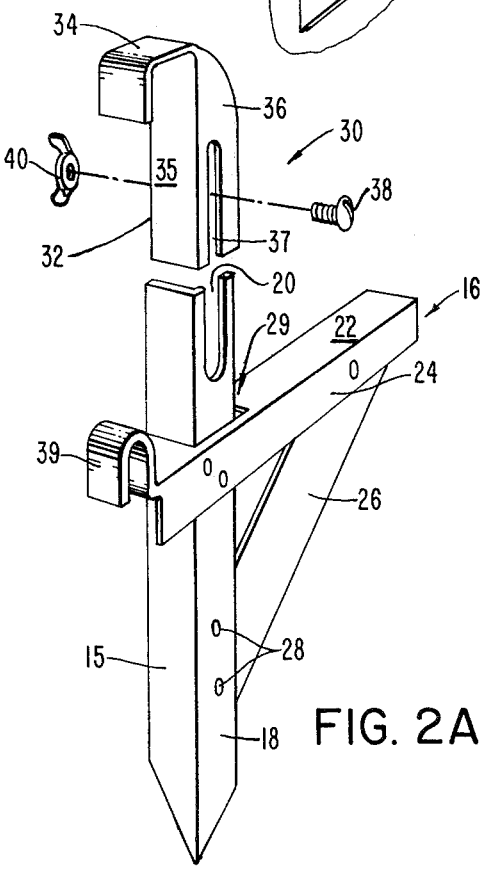
FIGS. 2A and 2B are front and rear exploded views, respectively, of the batter-board support shown in FIG. 1.
Figure 2B:
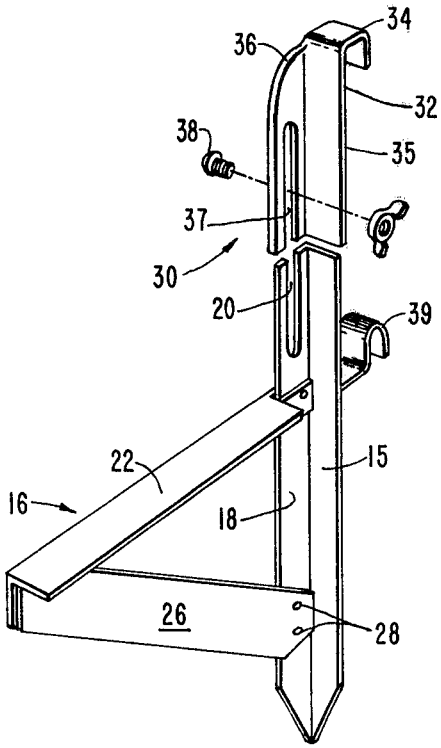

The support 10 shown in FIGS. 1, 2A and 2B includes a vertical fluke 14 which is driven into the ground at the perimeter of the skating surface and a horizontal arm 16 which is secured to the vertical fluke 14.

The fluke 14 has an L-shaped cross-section and is tapered at the bottom end. Accordingly, the fluke 14 has a front surface 16 and a side surface 18. The top end of the fluke 14 has a slot 20. The horizontal arm 16 also has an L-shaped cross-section with a top surface 22 and a side surface 24. The arm 16 connects to the vertical fluke 14 by a bracket 26 and rivets 28. The top surface 22 is notched at 29 to enable the surfaces 18 and 24 to be flush where the fluke 14 and arm 16 are joined for greater support strength. The bracket 26 is shown forming an approximately 45 degree angle with the fluke 14 and the arm 16. A cap piece 30 comprises a vertical fluke extension 32 and an L-shaped bracket 34. The extension 32 has front and side surfaces 35 and 36, respectively, and cap bracket 34 extends horizontally and downward from the extension 32.

The lower end of the side surface 36 includes a slot 37 which aligns with the slot 20 in the surface 18 of vertical fluke 14. This embodiment of the invention includes a hook-shaped tab 39 which extends up vertically from the left hand end of the horizontal cross arm 16. The tab 39 may be formed from an extension of the top surface 22.

In use, the vertical fluke 14 is driven into the ground or other base material to define the perimeter of the skating surface. The top surface 22 of the arm 16 is flush with the ground. The arm 16 provides improved lateral support for the fluke 10 when installed in this manner. The batter-board 11 seats on top surface 22 of the horizontal arm 16 and the front surface 15 of the fluke 14. The cap piece 30 is aligned with the fluke 14 so that the slots 20 and 37 align. The cap piece 30 is lowered until the horizontal portion of bracket 34 rests on top of the batter-board and the slots 20 and 37 are adjacent. A bolt 38 passes through the slots 20 and 37 and is secured by a nut 40 to frictionally secure the fluke 14 to the extension 32. In this embodiment, the batter-board 11 is securely enclosed by the extension 32, horizontal arm 16, bracket 34 and tab 39.

The liner 12 passes over the tab 39 and between the board 11 and the support 10. The liner is shown folded back over the cap bracket 34 and board 11 and frictionally secured to the board by U-shaped caps 42.

This embodiment provides a batter-board support which is easily installed and adjusts to accommodate a range of board widths.

Figure 3:
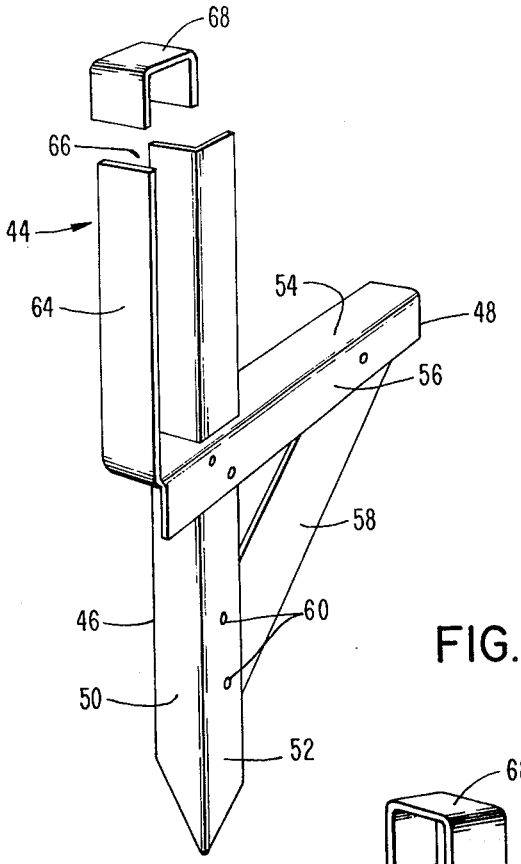
FIG. 3 is a perspective view of a second embodiment of the invention.
Figure 4:
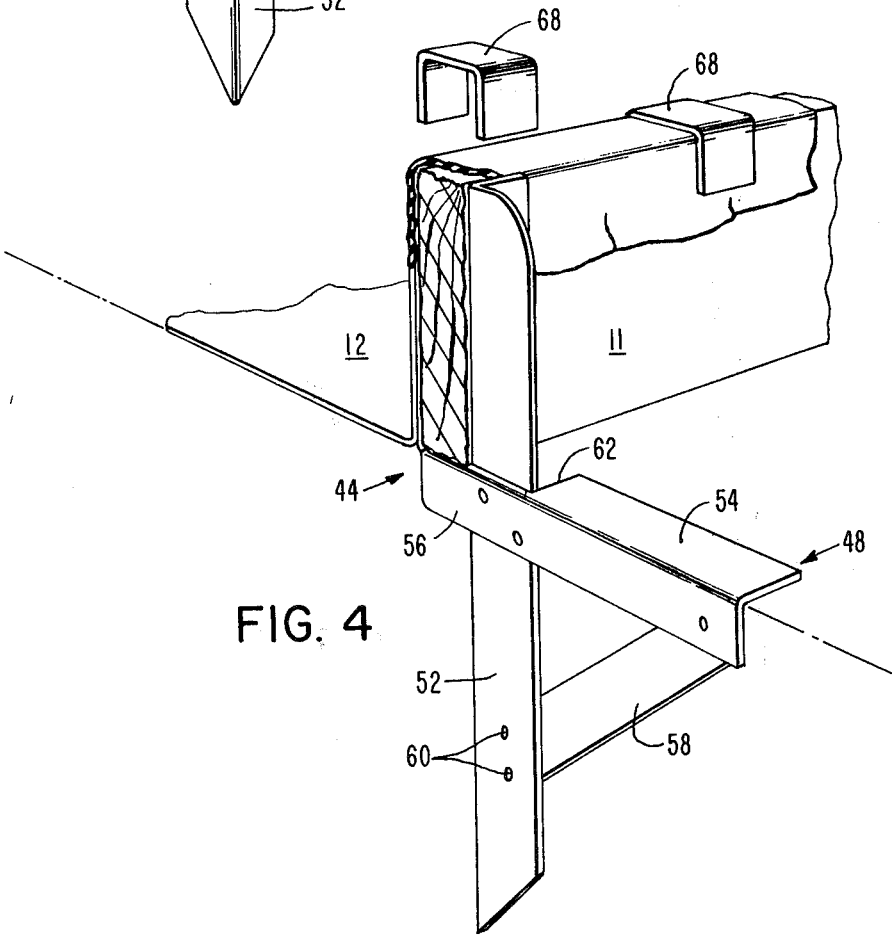
FIG. 4 is a perspective view of the support shown in FIG. 3 securing a batter-board.

FIGS. 3 and 4 depict a second embodiment of the invention. In this embodiment, the support, shown generally at 44, comprises a fluke 46 and an arm 48 which each have an L-shaped cross-section. Accordingly, the fluke 46 has a front surface 50 and a side surface 52 and the arm 48 comprises a top surface 54 and a side surface 56. In this embodiment the support 44 is secured to the ground in a manner similar to that described in conjunction with FIGS. 1 and 2.

The horizontal arm 48 is secured to the vertical fluke 46 by a bracket 58 and rivets 60. The top surface 54 is notched at 62 where the fluke 46 and arm 48 are secured. A vertical tab 64 extends upward from one end of the horizontal arm 48 to form a slot 66. The tab 64 is formed from a continuation of the top surface 54 which is bent up at a right angle to the surface.

The batter-board 11 is shown seated in the slot 66 (FIG. 4) and held in place by the vertical fluke 46, arm 48 and vertical tab 64. The batter-board 11 comprises inexpensive lumber or other suitable material. This embodiment of the support 44 is particularly advantageous for replacing the batter-board 11 without completely dismantling the skating rink.

A U-shaped cap 68 is shown frictionally secured over the board 11 to secure the board 11 into the slot 66. The liner 12 is draped over the board 11 and the support 44. The caps 68 functionally secure the liner 12 to the top edge of the board 11.

From the foregoing, it can be seen that the objectives of the invention have been accomplished.

It will be clear to those skilled in the art the various changes may be made from the foregoing without departing from either the spirit or the scope of the invention and it is intended that such changes be encompassed herein, the scope of the invention being defined with particularity in the attached claims.

I claim:

1. A support for a skating rink batter-board including:

a. a vertical fluke adapted to be fixed in a base medium around the perimeter of a skating surface, b. a horizontal arm attached to said vertical fluke, c. a tab spaced from said fluke and extending up vertically from said horizontal arm, said tab and fluke forming the sidewalls, and said arm forming the bottom wall of a slot for receiving a batter-board and securing it in place around the perimeter of the skating surface.

2. A batter-board support as defined in claim 1 further including a U-shaped cap fitting over the top edge of the batter-board and frictionally engaging the vertical tab and the batter-board for positively securing the batter-board in the slot.

3. A batter board support as defined in claim 2 wherein the bottom end of the vertical fluke is tapered to facilitate driving the stake into the base medium.

4. A batter-board support as defined in claim 2 including a support bracket which attaches to the vertical fluke and horizontal arm and forms an approximate 45° angle with each.

5. A support for a skating rink adapted to be fixed in a base medium batter-board including:

a. a vertical fluke adapted to be fixed in a base medium around the perimeter of a skating surface, a horizontal arm connecting to said vertical fluke, c. a cap piece d. an L-shaped bracket having a first portion thereof extending horizontally and having a second portion thereof extending downward from the top of the cap piece, whereby the batter-board seats against the fluke and the arm and the cap piece aligns with said fluke so that the horizontal portion of the L-shaped bracket rests on top of the batter-board, and e. means for securing said cap piece to said vertical fluke for securing the batter-board around the perimeter of the skating surface.

6. A batter-board support as defined in Claim 5 wherein a. said vertical fluke includes a slot in its top end b. said cap piece having a slot in its bottom end whereby the slot in the fluke and the slot in the cap piece are aligned and adjacent.

c. said means for securing said cap piece to said vertical fluke extends through said slots and frictionally engages said fluke and cap piece.

7. A batter-board support as defined in claim 6 including a tab extending upward from said horizontal arm distal of said batter-board from said fluke for positively retaining the batter-board on said horizontal arm.

8. A batter-board support as defined in claim 7 including a support bracket which attaches to the vertical fluke and horizontal arm and forms an approximate 45° angle with each.

9. A batter-board support as defined in claim 8 wherein the bottom end of the vertical fluke is tapered to facilitate driving the stake into the base medium.

* * * * *